US008307553B2

(12) United States Patent
Follo et al.

(10) Patent No.: US 8,307,553 B2
(45) Date of Patent: Nov. 13, 2012

(54) RAZOR CARTRIDGE

(75) Inventors: Thomas A Follo, Milford, CT (US); Paul D Richard, Shelton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 331 days.

(21) Appl. No.: 12/570,668

(22) Filed: Sep. 30, 2009

(65) Prior Publication Data

US 2010/0077619 A1 Apr. 1, 2010

Related U.S. Application Data

(63) Continuation-in-part of application No. 12/434,309, filed on May 1, 2009, now Pat. No. 8,191,263.

(60) Provisional application No. 61/049,608, filed on May 1, 2008.

(51) Int. Cl.
*B26B 21/40* (2006.01)

(52) U.S. Cl. ..... 30/41; 30/50

(58) Field of Classification Search ..... 30/34.05, 30/41, 50, 58, 77, 84, 537
See application file for complete search history.

(56) References Cited

U.S. PATENT DOCUMENTS

| | | | | |
|---|---|---|---|---|
| 979,296 | A | 12/1910 | Heissenberger | |
| 1,741,891 | A | 12/1929 | Vallon | |
| 2,677,883 | A | 5/1954 | Schallgruber | |
| 3,895,437 | A | 7/1975 | DiBuono | |
| 4,586,255 | A | 5/1986 | Jacobson | |
| 4,625,402 | A * | 12/1986 | Kavoussi | 30/41 |
| 6,032,372 | A * | 3/2000 | Dischler | 30/346.57 |
| 6,161,287 | A | 12/2000 | Swanson et al. | |
| 6,216,345 | B1 * | 4/2001 | Andrews | 30/50 |
| 7,197,825 | B2 * | 4/2007 | Walker et al. | 30/77 |
| 7,540,088 | B2 * | 6/2009 | Takeshita | 30/34.2 |
| 7,690,122 | B2 * | 4/2010 | Worrick et al. | 30/526 |
| 7,802,353 | B2 * | 9/2010 | Gratsias et al. | 29/524.1 |
| 7,877,879 | B2 * | 2/2011 | Nakasuka | 30/41 |
| 2006/0143925 | A1 * | 7/2006 | Johnson et al. | 30/50 |
| 2007/0056167 | A1 * | 3/2007 | Richard et al. | 30/50 |
| 2008/0209734 | A1 * | 9/2008 | Nicoll | 30/41 |
| 2009/0188112 | A1 * | 7/2009 | Prochaska et al. | 30/34.05 |
| 2009/0211099 | A1 * | 8/2009 | Louis | 30/41 |
| 2010/0107416 | A1 * | 5/2010 | Follo | 30/41 |
| 2011/0119922 | A1 * | 5/2011 | Ntavos et al. | 30/32 |

FOREIGN PATENT DOCUMENTS

| | | | |
|---|---|---|---|
| EP | 1935588 | A1 | 6/2008 |
| WO | WO 2008 053814 | A1 | 5/2008 |

* cited by examiner

*Primary Examiner* — Hwei C Payer
(74) *Attorney, Agent, or Firm* — Energizer Personal Care, LLC

(57) ABSTRACT

A razor cartridge has a frame, a razor blade resiliently mounted in the frame, a cartridge retainer disposed around a portion of a periphery of the frame; and a separable lubrication articulately connected to the frame and selectively moveable between a forward position and a locked position. The cartridge retainer has a first portion that includes a surface that defines a skin engaging surface when the separable lubrication is in the locked position and second portions at opposed ends of the first portion that retain the blade in the frame and include means to fixedly attach the cartridge retainer to the frame.

9 Claims, 8 Drawing Sheets

RAZOR CARTRIDGE

CROSS REFERENCE TO RELATED APPLICATIONS

This application is a continuation-in-part of U.S. patent application Ser. No. 12/434,309, filed May 1, 2009, now U.S. Pat. No. 8,191,263 which claims the benefit U.S. Provisional Patent Application Ser. No. 61/049,608, filed May 1, 2008.

BACKGROUND

1. Technical Field

The present disclosure relates to razor cartridges in general, and, more particularly, to razor cartridges including a retainer.

2. Background Information

Many modern safety razors include a disposable razor cartridge adapted to be connected to a handle by connecting structure therebetween. The cartridge includes a frame having at least one razor blade with a cutting edge disposed therein. Some modern razor cartridges include cap structure of the frame having a lubricating strip, sometimes referred to as a shaving aid strip that can enhance shaving comfort by reducing friction and/or imparting shaving aids during use.

Although the lubricating strip can be successful in enhancing comfort during use, these strips and their associated cap structure can be relatively wide. This can often hinder the shaving process. For example, when shaving hard to reach areas (e.g., under the nose) or areas that require precision (e.g., sideburns), the cap structure can often physically impede the accurate placement of the razor blade on the desired location and/or make it difficult to pre-determine exactly where the blade will contact the skin and begin shaving. Such difficulties can lead to areas of the skin left unshaven, as well as areas shaven where the user did not wish to shave.

Commonly assigned U.S. patent application Ser. No. 12/434,309 discloses a safety razor that addresses this problem by providing the lubricating strip or lubricating member as a separate member additional to and articulately connected to the frame of the cartridge. This so-called separable lubrication can be selectively operated by a user for trimming operations, which can enable the user to see the area to be shaved more clearly. The outer surface of the rear wall of the frame of the razor cartridge is as close to the cutting edge of the blade as possible. For example, the aforementioned '309 application discloses the outer surface of the rear wall rear edge is preferably less 2 mm from the cutting edge. However, such a narrow rear wall should still provide structural stability to the cartridge frame, especially in the event that a safety razor having such a razor cartridge, and having the cartridge in its trimming (or locked) position is accidentally dropped.

Some modern razor cartridges include a plurality of razor blades (e.g., two, three, four, five or more) disposed in the frame, the blades being resiliently mounted in the frame and being moveable relative to the frame away from an at-rest position in response to forces encountered during shaving. U.S. Pat. No. 4,586,255 to Jacobson discloses such a razor cartridge having two razor blades. The cartridge assembly includes a pair of spring clamps disposed in respective grooves at each end of the frame and enveloping the respective ends of the frame. The spring clamps retain the blades in the frame and define the at-rest positions for the blades. U.S. Pat. No. 6,161,287 to Swanson et al. discloses such a razor cartridge having three blades and an annular retainer clip that is disposed about the periphery of the frame and serves to retain the blades onto the frame and define the at-rest positions for the blades.

SUMMARY

The present disclosure has for its objective to eliminate, or at least substantially alleviate the limitations of the prior art cartridge retainers when employed with razor cartridges having a separable lubrication. A razor cartridge has a frame, one or more razor blades mounted in the frame, a cartridge retainer disposed around a portion of a periphery of the frame and a separable lubrication articulately connected to the frame. The separable lubrication can be selectively moveable between a forward position and a locked position. The cartridge retainer includes a first portion that has a surface that defines a skin engaging surface when the separable lubrication is in the locked position and a second portion that retains the blade in the frame. The cartridge retainer includes means to fixedly attach the cartridge retainer to the frame, for example by bending a tab against the frame, use of a suitable adhesive, welding, riveting, staking or insert molding the cartridge retainer in the frame. The cartridge retainer includes a rear wall that defines the rear edge of the razor cartridge when the separable lubrication is in the locked position. The rear wall is preferably spaced less than 3 mm from a cutting edge of the razor blade and more preferably spaced less than 2 mm from the cutting edge of the razor blade. The cartridge retainer is preferably manufactured from aluminum to provide galvanic corrosion protection for the razor blade.

The above-mentioned features are effective to produce a razor cartridge having a separable lubrication that can resist abnormal abuse, such as accidental dropping e.g. onto tile flooring in a shower during use. The cartridge retainer helps provide structural stability to the cartridge frame and retention and location of the various elements of the razor cartridge are assured during usage of the system.

These and other advantages of the present disclosure will be apparent to one of ordinary skill in the art in light of the following Detailed Description and Drawings.

DETAILED DESCRIPTION

Figure 1:
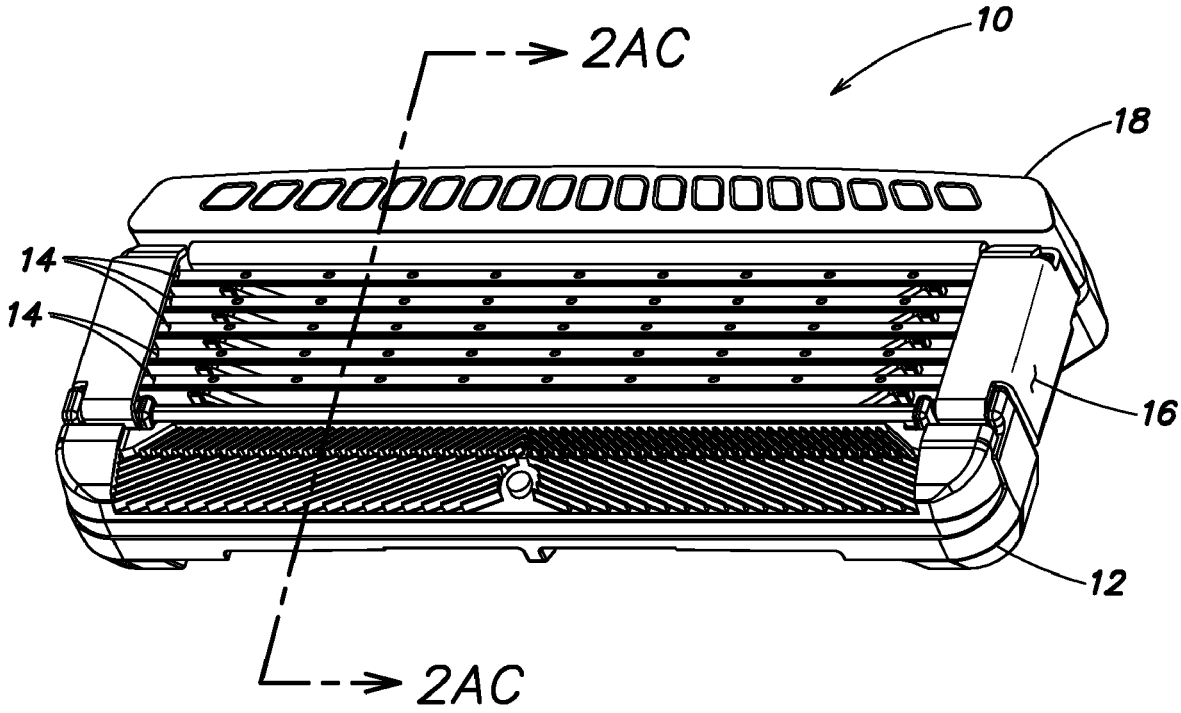
FIG. 1 is a perspective view of an exemplary razor cartridge of the present disclosure.

Referring now to the drawings and in particular to FIG. 1, an exemplary razor cartridge 10 of the present disclosure includes a frame 12, one or more razor blades 14, a cartridge retainer 16 and a separable lubrication 18. The separable lubrication 18 is articulately connected to the frame and is selectively moveable between a forward position (e.g. for normal shaving) and a defined locked position (e.g. for trimming). In the context of the present application "selectively moveable" is understood to mean the separable lubrication is moveable from its forward position to its locked position by a definite and conscious manual operation by a user. An exemplary separable lubrication is disclosed in commonly assigned U.S. patent application Ser. No. 12/434,309, incorporated herein by reference for essential disclosure relating to construction, assembly and functions of a separable lubrication.

Figure 2A:
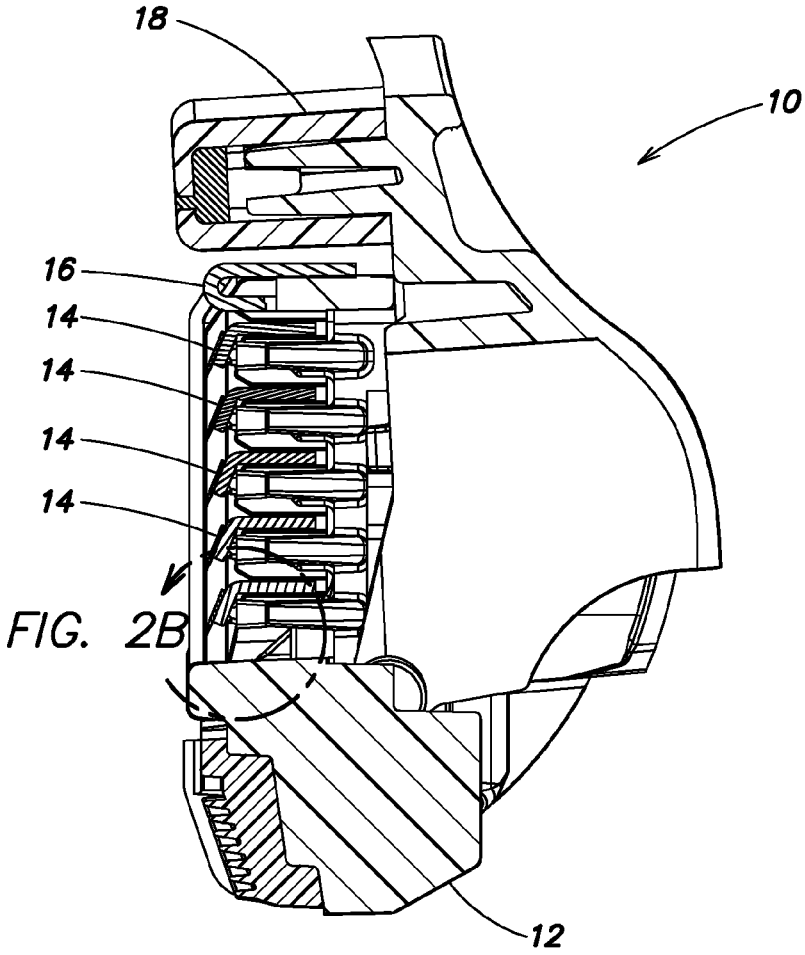
FIG. 2A is a sectional view along lines 2A-2A of FIG. 1 showing a separable lubrication in a forward position and an enlarged portion thereof.
Figure 2B:
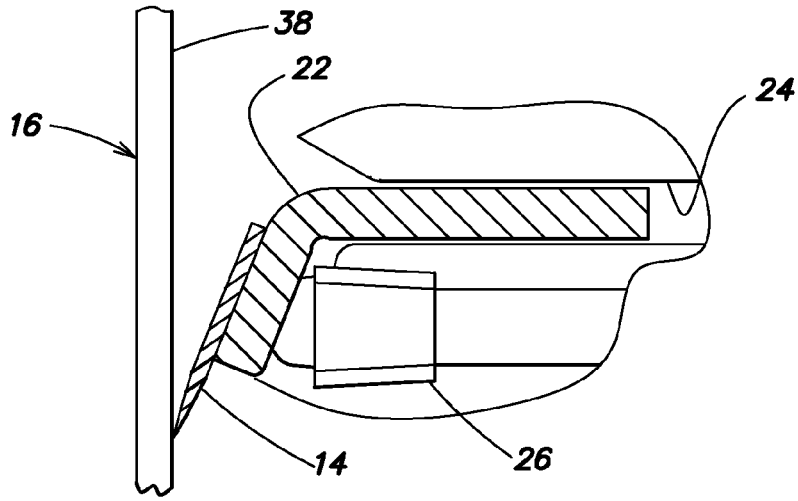
FIG. 2B is an enlarged portion of FIG. 2A.
Figure 2C:
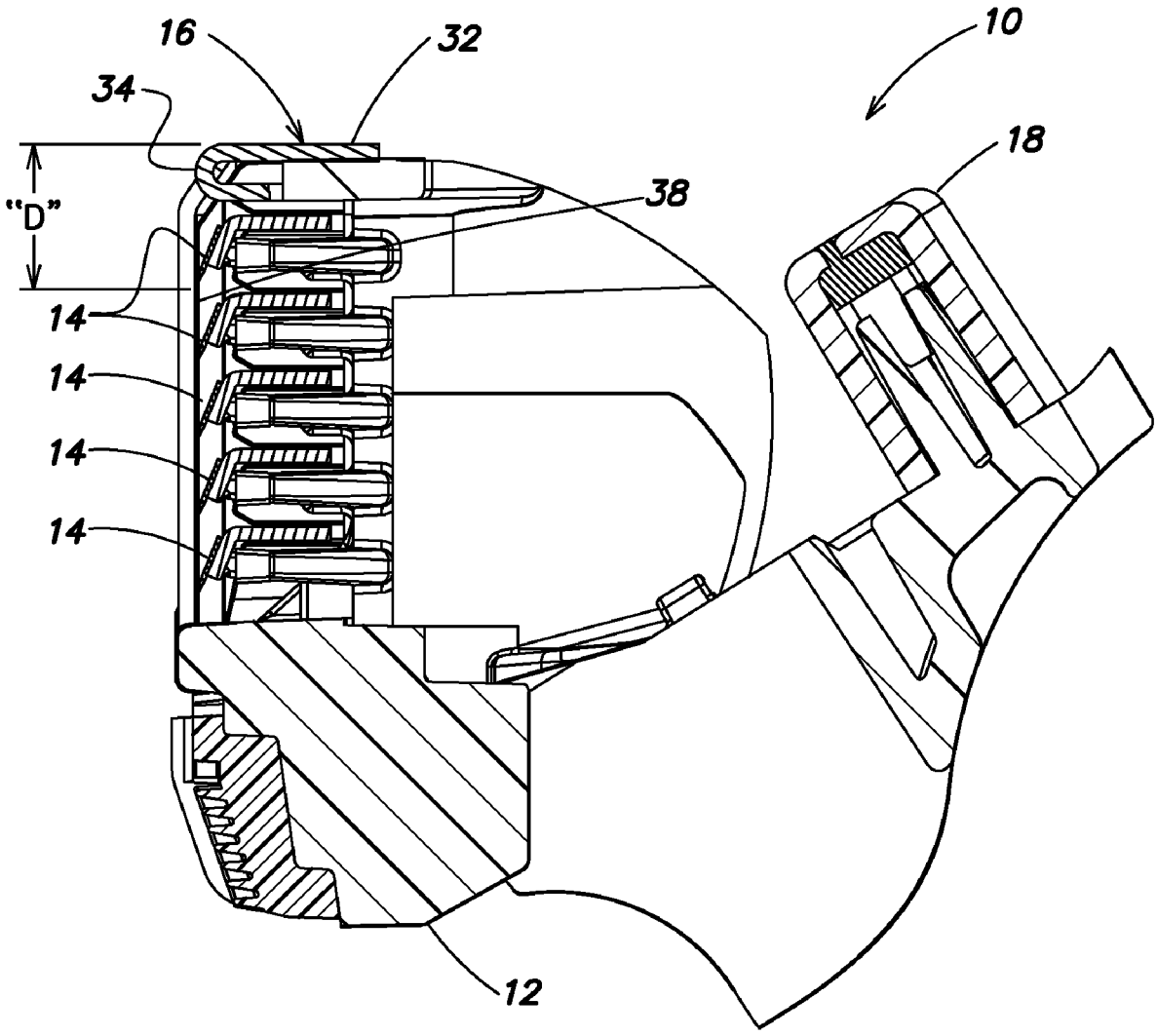
FIG. 2C is a sectional view along lines 2C-2C of FIG. 1 showing a separable lubrication in a locked position.

Referring additionally to FIGS. 2A and 2C, these show respective sectional views of the razor cartridge of FIG. 1 taken along line 2AC-2AC with the separable lubrication in a forward position and a locked position.

Each razor blade 14 can be mounted on a support 22. Portions of the support 22 are in elongated slots 24 of the frame. Spring fingers 26 of the frame provide a spring force to urge the razor blade to its at-rest position and to permit movement of the razor blade relative to the frame away from an at-rest position along the elongated slots in response to forces encountered during a normal shaving operation. In another embodiment, the support can be omitted and the razor blade can include a bent portion. The razor blade can be an approximate "L" shape in a transverse cross section as is known in the art.

Referring now to FIGS. 5-8, certain views of a cartridge retainer 16 are shown. The cartridge retainer 16 has a first portion 30 and a second portion 36. Preferably the cartridge retainer has two second portions 36 disposed at opposed ends of the first portion 30. Referring back to FIG. 2C, the first portion of the cartridge retainer is preferably "J" or "U" shaped in a transverse cross section. The "J" or "U" shape includes a surface 34 that defines a skin engaging surface of the razor cartridge when the separable lubrication is in the locked position. The first portion 30 of the cartridge retainer also includes a rear wall 32 that defines the rear edge of the razor cartridge when the separable lubrication is in the locked position. Preferably the rear wall 32 is spaced less than 3 mm and more preferably less than 2 mm from the cutting edge of the razor blade or the cutting edge of the rearwardmost razor blade of a razor cartridge having more than one razor blade, depicted as dimension "D" in FIG. 2C.

Figure 3:
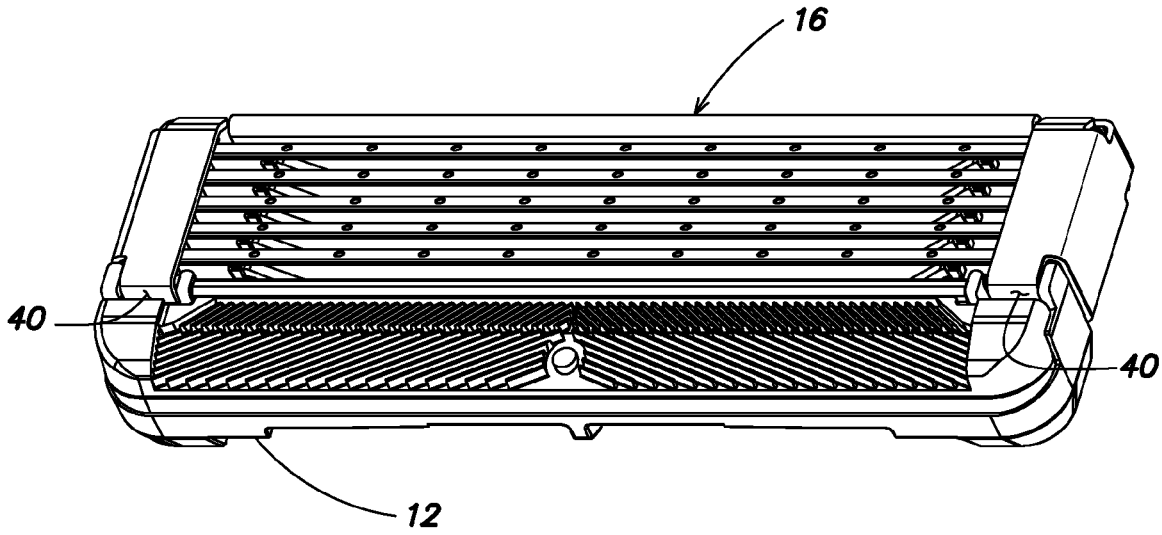
FIG. 3 is an upper perspective view of the razor cartridge of FIG. 1 with the separable lubrication removed purely for convenience of illustration.
Figure 4:
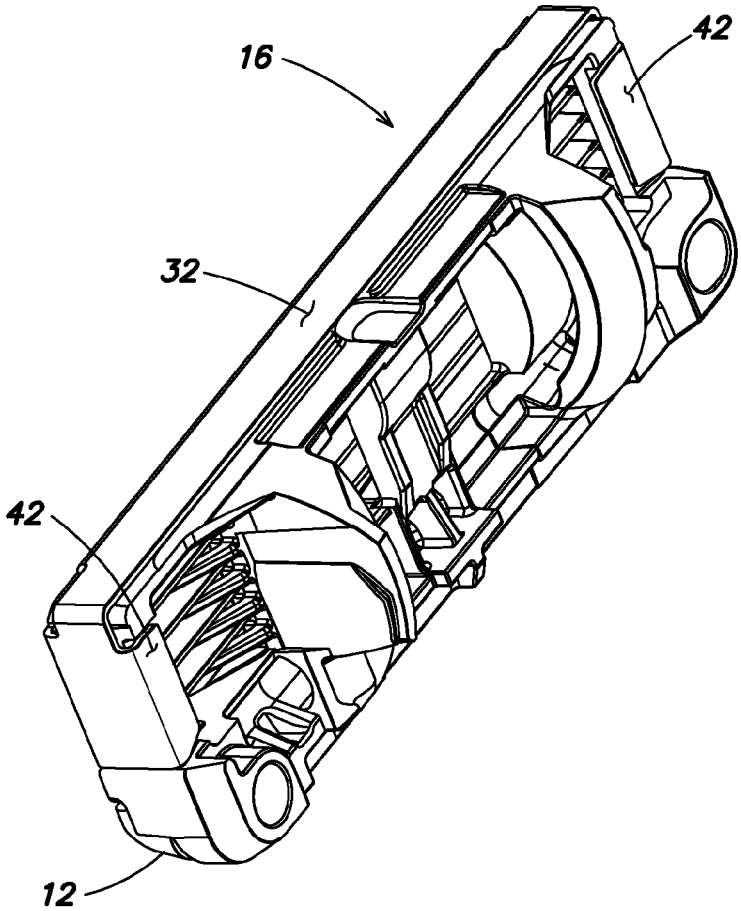
FIG. 4 is a lower perspective view of the razor cartridge of FIG. 1 with the separable lubrication removed purely for convenience of illustration.
Figure 8:
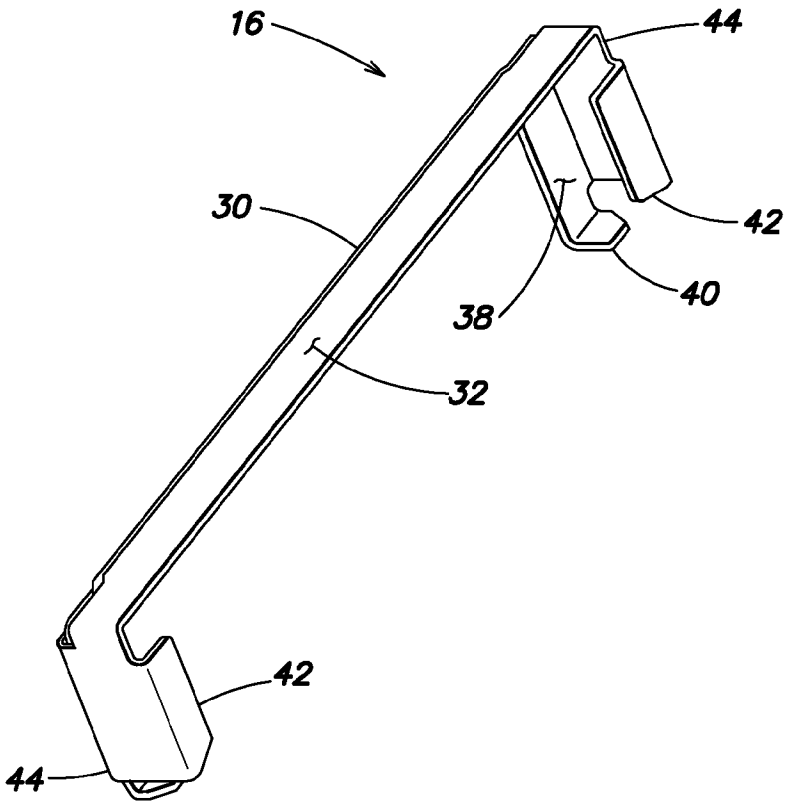
FIGS. 5-8 are respective upper perspective, top, front and lower perspective views of an exemplary cartridge retainer of the present disclosure.
Figure 5:
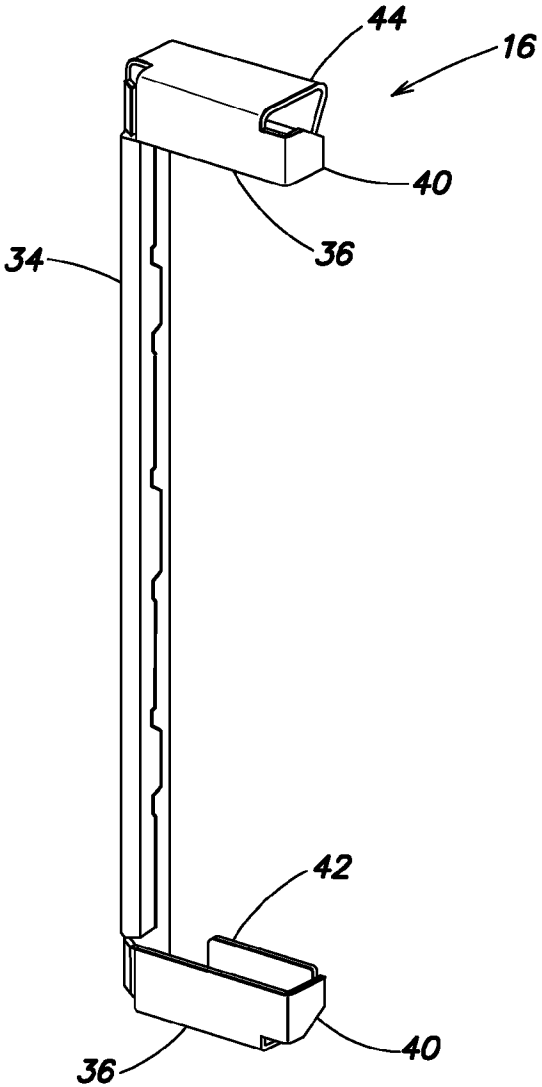
Figure 6:
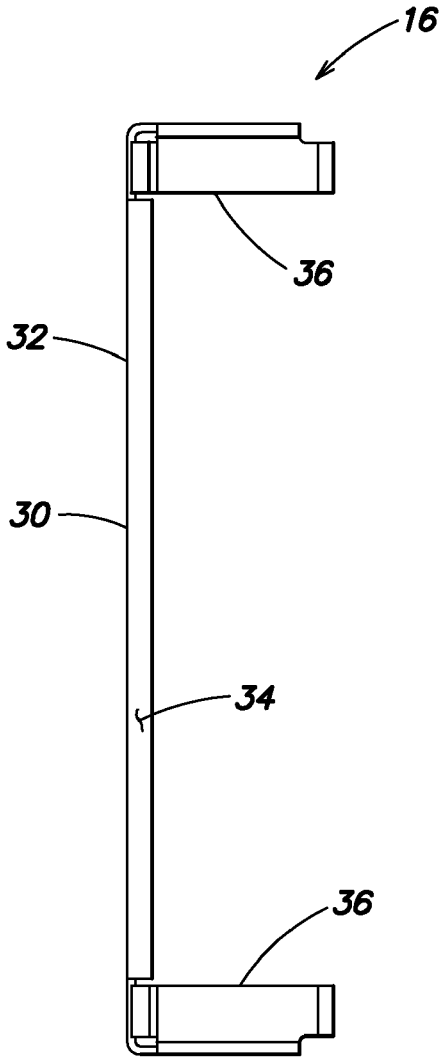
Figure 7:
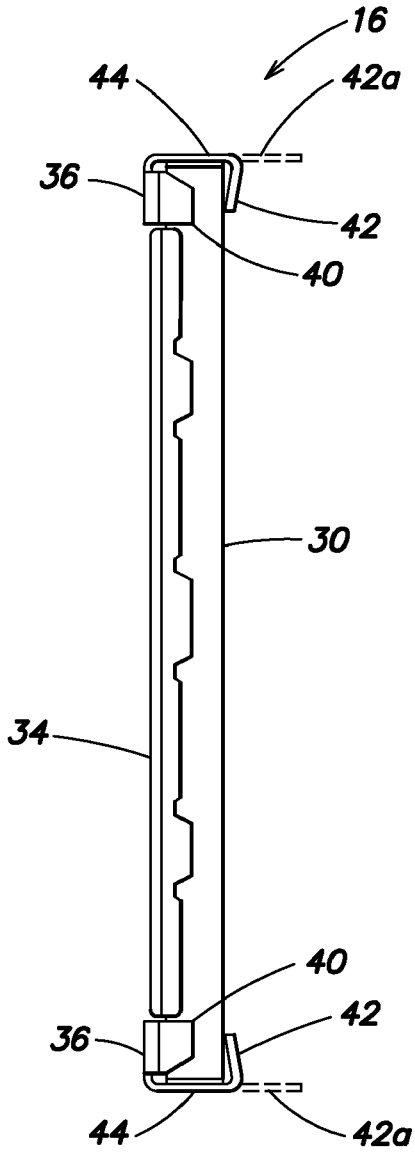

The cartridge retainer 16 includes a second portion 36 preferably integrally formed with the first portion to provide a monolithic structure. The second portion 36 includes a datum surface 38 that defines the at-rest position of the razor blade (see FIG. 2B). The second portion can include tab 40 that interacts with a mating wall of the frame (not identified, see FIG. 3) to fixedly locate the cartridge retainer in a fore and/or aft direction relative to the frame. The second portion can include a second tab 44 that interacts with a mating outer end wall of the frame (not identified, see FIG. 3) to fixedly locate the cartridge retainer in a lateral direction relative to the frame. The second portion includes a third tab 42 that preferably extends from second tab 44 and is bent inward (from position shown as 42*a*) against the underside of the frame to fixedly attach the cartridge retainer to the frame.

Figure 9:
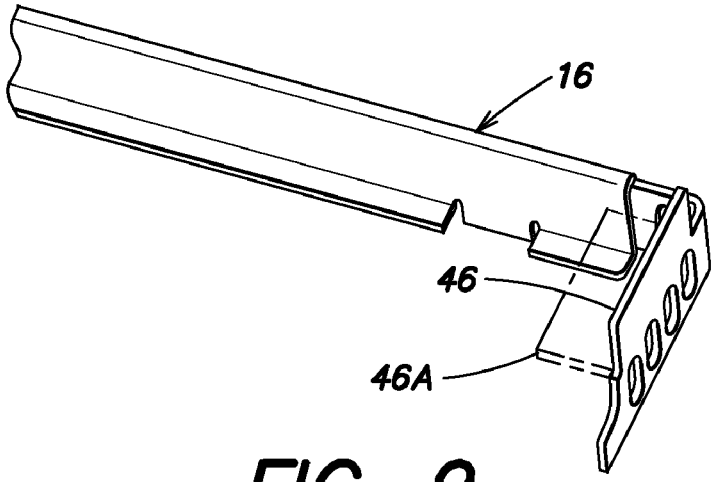
FIG. 9 is a perspective view of a portion of a portion of another embodiment of a cartridge retainer.
Figure 10:
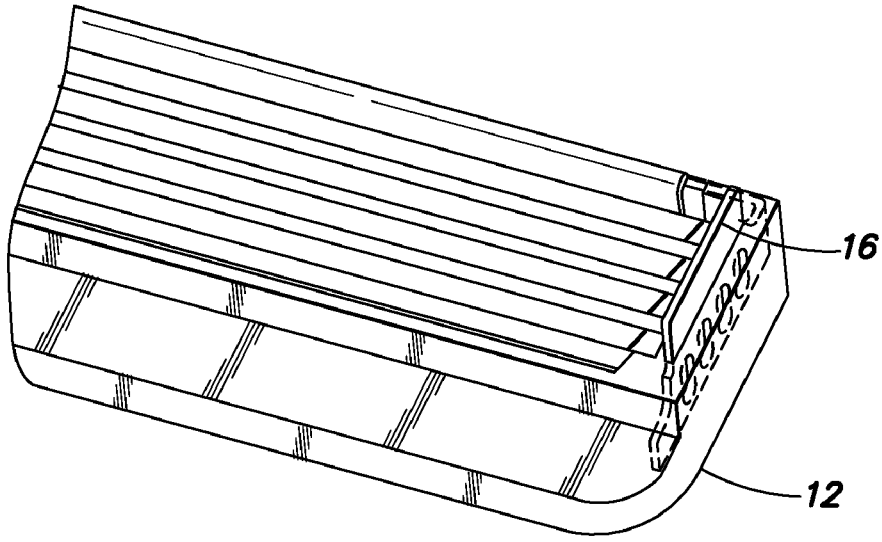
FIG. 10 is a perspective view of a portion of a portion of another embodiment of a razor cartridge.
Figure 11:
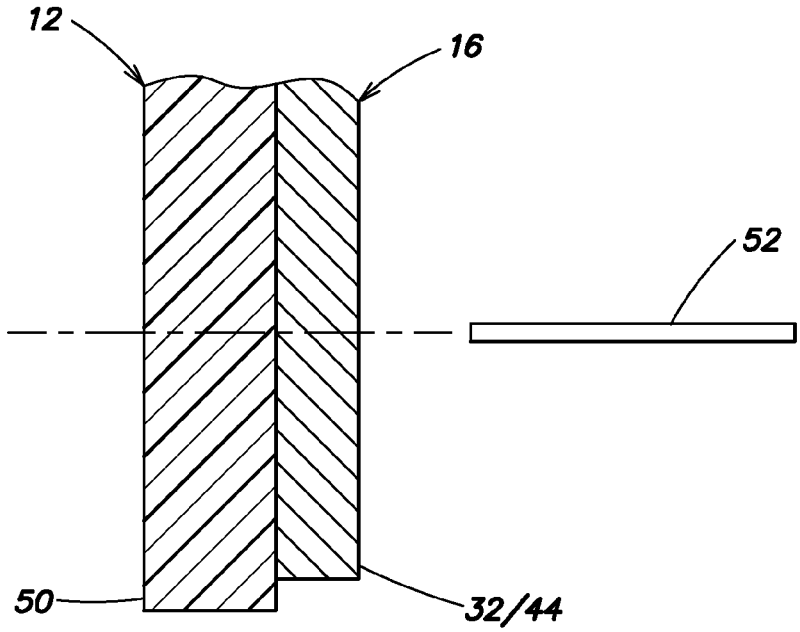
FIG. 11 is portion of a sectional view of a further embodiment of a razor cartridge.
Figure 12:
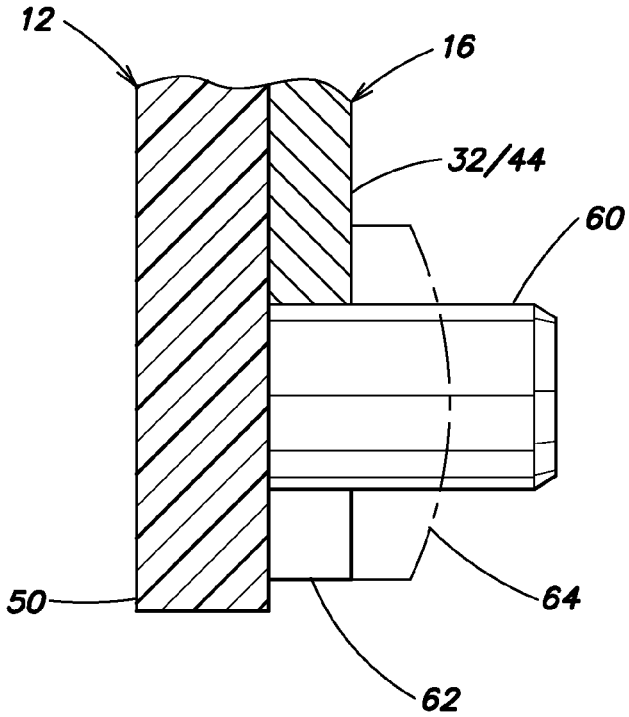
FIG. 12 is portion of a sectional view of a yet further embodiment of a razor cartridge.

In other embodiments of the cartridge retainer, other means for fixedly attaching the cartridge retainer to the frame can be employed in addition to, or in the alternate to the third tab 42, which can be omitted. For example the cartridge retainer can be attached by use of a suitable adhesive between the frame and the cartridge retainer. A suitable adhesive is a cyanoacrylate (CA) adhesive, e.g. LOCTITE 401 or LOCTITE 420 manufactured by HENKEL. Other suitable adhesives include epoxy adhesives, e.g. a two-part epoxy. Referring now to FIGS. 9 and 10, the cartridge retainer 16 can be insert-molded in the frame 12 to fixedly attach it thereto (depicted in dashed lines in FIG. 10). A further tab 46 is bent inward to its position shown as 46*a* (in FIG. 9) after the razor blade(s) are assembled to the frame to retain the blades in the frame and provide a datum surface that defines the at-rest position of the razor blade(s). Referring now to FIG. 11, a portion of a sectional view of a further embodiment of a razor cartridge is depicted showing a portion of a side wall 50 of the frame 12 and a portion of the cartridge retainer 16 that can be for example rear wall 32 and/or second tab 44. Pin 52 is inserted through the wall or tab of the cartridge retainer and the wall of the frame to stake the cartridge retainer to the frame. Referring now to FIG. 12, a portion of a sectional view of a yet further embodiment of a razor cartridge is depicted showing a portion of a side wall 50 of the frame 12 and a portion of the cartridge retainer 16 that can be for example rear wall 32 and/or second tab 44. A pin 60 of the frame wall passes through an aperture 62 cartridge retainer. Preferably the aperture 62 is open at one end for ease of assembly. The outer end portion of the pin 60 is plastically deformed to provide head 64 to fixedly attaching the cartridge retainer to the frame. A cartridge retainer manufactured from a thermoplastic material can also be fixedly attached to the frame by welding, e.g. ultrasonic welding.

The cartridge retainer 16 is preferably manufactured by a perforation and forming process and is preferably manufactured from aluminum, most preferably the grade designated AL 5052-H16 and having a thickness about 0.3 mm. The cartridge retainer is preferably aluminum as this can act as a sacrificial anode in use and can provide galvanic protection to inhibit corrosion of the razor blade. However the present disclosure is not limited in regard of the material or manufacturing method of the cartridge retainer and alternatives are within the scope of the present disclosure. The cartridge retainer preferably comprises a relatively rigid, high strength and impact resistant material such as a metal (e.g. the aforementioned aluminum) or a so-called "engineering grade" thermoplastic. The cartridge retainer provides structural stability to the frame, especially in the event that a safety razor having a razor cartridge of the present disclosure, and having the separable lubrication in the locked position, is accidentally dropped. One of skill in the art will understand that molded thermoplastic materials such as glass fiber or carbon fiber reinforced NYLON can be used in the alternative for the cartridge retainer.

The cartridge retainer 16 can also be provided with a coating. It is preferred that the coating be on the outer surface and that the cartridge retainer 16 is uncoated on its underside to provide the aforementioned galvanic protection for the blades. It is preferred that the coating is a polymer coating formed from materials such as polyester, epoxy or two-layer vinyl and polyester systems. The coating can also be an anodized coating. Because the cartridge retainer 16 includes a skin contacting surface it is desirable that the coating provide low friction characteristics.

From the above it should be evident that the razor cartridge 10 includes structure which is simple to manufacture and assemble, and which will withstand the rigors of inadvertent dropping or other mishaps.

While various embodiments have been described above, it should be understood that they have been presented by way of example only, and not limitation. For instance, modifications or changes as can be made within the scope of the attached claims and features disclosed in connection with any one embodiment can be used alone or in combination with each feature of the respective other embodiments. Thus, the breadth and scope of any embodiment should not be limited by any of the above described exemplary embodiments, but should be defined only in accordance with the following claims and their equivalents.

What is claimed is:

1. A razor cartridge, comprising:

a frame;

a razor blade resiliently mounted in the frame and moveable relative to the frame away from an at-rest position in response to forces encountered during a normal shaving operation;

a cartridge retainer disposed around a portion of a periphery of the frame; and a separable lubrication articulately connected to the frame and selectively moveable between a forward position and a locked position;

wherein the cartridge retainer includes a first portion that includes a surface that defines a skin engaging surface when the separable lubrication is in the locked position; and a second portion that retains the blade in the frame and defines the at-rest position of the razor blade;

wherein the razor cartridge further including means to fixedly attach the cartridge retainer to the frame;

wherein when the separable lubrication is in the forward position, the separable lubrication is adjacent the cartridge retainer and both the razor blade and the separable lubrication are in contact with a user's skin during normal shaving; and wherein when the separable lubrication is in the locked position, the separable lubrication is not in contact with the user's skin during normal shaving.

2. The razor cartridge of claim 1, wherein the second portion of the cartridge retainer includes the means to fixedly attach the razor cartridge retainer to the frame.

3. The razor cartridge of claim 2, wherein the cartridge retainer comprises two second portions, each disposed at respective opposed ends of the first portion and each second portion includes the means to fixedly attach the cartridge retainer to the frame.

4. The razor cartridge of claim 1, wherein the first portion of the cartridge retainer further includes a rear wall, the rear wall defining the rear edge of the razor cartridge when the separable lubrication is in the locked position.

5. The razor cartridge of claim 4, wherein the rear wall is spaced less than 3 mm from a cutting edge of the razor blade.

6. The razor cartridge of claim 4, wherein the rear wall is spaced less than 2 mm from the cutting edge of the razor blade.

7. The razor cartridge of claim 4, wherein the cartridge retainer comprises two second portions, each disposed at respective opposed ends of the first portion and each second portion defines the at-rest position of the razor blade.

8. The razor cartridge of claim 1, wherein the cartridge retainer comprises aluminum.

9. The razor cartridge of claim 1, wherein the cartridge retainer is monolithic.

* * * * *